United States Patent [19]

Worrallo

[11] 4,442,992

[45] Apr. 17, 1984

[54] MODULAR SHELF SUPPORT

[76] Inventor: Anthony C. Worrallo, 15, Spott Rd., Kohrimarama, Auckland 5, New Zealand

[21] Appl. No.: 329,890

[22] Filed: Dec. 11, 1981

[30] Foreign Application Priority Data

Dec. 11, 1980 [NZ] New Zealand ..... 195809

[51] Int. Cl.[3] ..... A47G 29/02

[52] U.S. Cl. ..... 248/243; 211/182

[58] Field of Search ..... 248/243, 241, 244, 297.2, 248/246, 257, 265, 256; 211/182, 193, 190; 403/348, 252, 254, 381

[56] References Cited

U.S. PATENT DOCUMENTS

| | | | |
|---|---|---|---|
| 2,355,651 | 8/1944 | Hormes | 248/243 |
| 3,186,561 | 6/1965 | Strassle | 211/182 |
| 4,065,904 | 1/1978 | Taylor et al. | 211/193 X |
| 4,094,417 | 6/1978 | Cairnes et al. | 211/182 X |
| 4,345,849 | 8/1982 | Stenemann | 403/252 |

FOREIGN PATENT DOCUMENTS

| | | | |
|---|---|---|---|
| 2358828 | 5/1975 | Fed. Rep. of Germany | 248/243 |
| 2064305 | 6/1981 | United Kingdom | 248/243 |

*Primary Examiner*—Ramon S. Britts
*Assistant Examiner*—Sarah A. Lechok
*Attorney, Agent, or Firm*—Roylance, Abrams, Berdo & Goodman

[57] ABSTRACT

A structure is disclosed in which there are uprights to which brackets are releasably attached. Each upright is in the form of an extrusion having a core structure (12) with webs (14) extending outwardly from the core structure (12). There are lips (26) at the outer ends of the webs (14) and these components bound an elongate cavity (30). In the core structure (12) there is a further cavity (18) with a slot-like entrance (24) placing the two cavities (18, 30) in communication. The lips (22) bounding the entrance (24) are cut away at at least one place to widen the entrance (24). The bracket has a head which is received in the cavity (30) and a boss which enters the cavity (18) at the (or one of the) widened part of the entrance (24). In a further form there is an element in the cavity (18) which element extends across the entrance (24) and which has a series of boss receiving apertures therein.

6 Claims, 7 Drawing Figures

MODULAR SHELF SUPPORT

This invention relates to structures in which brackets are releasably secured to structural elements. Such structures are widely used in shelving systems.

Shelving systems are known in which each upright of the system is in the form of a channel having an elongate cavity access to which is by way of an elongate slot-like entrance. The entrance is bounded by two longitudinally extending lips which, in conjuntion with the rear web and two flanges of the upright, substantially close the cavity.

Each bracket is provided with a head which is on the free end of a protruding neck. The dimensions of the head are greater in the horizontal direction than in the vertical direction. When the bracket is in its operative position, the head is in the elongate cavity with the ends thereof behind the lips. When the bracket is turned through 90° the head can be removed from the cavity through said entrance as the smaller dimension of the head is then the horizontal one.

Various methods have been proposed by means of which slip of the bracket down the upright when it is subjected to load can be inhibited. In one prior proposal, the head has a boss thereon and the upright is punched to form a through bore for receiving the boss. In another form the head is at a position on the upper portion of the bracket and the protrusion is at a position on the lower portion of the bracket. In this form the upright is again punched to form a through bore.

An inherent difficulty in both these systems is that the hole punched through the upright requires a heavy duty punching operation which is expensive. Furthermore, since the bore penetrates through the rear web of the upright, this solution can only be applied where the upright is of simple form. It will be understood that if the web is a common web between two elongate cavities, then when a bracket is inserted in the bore at one level the boss extends into or through the bore sufficiently far to prevent a bracket being located at the same level on the other side of the upright. A possible solution is to thicken the web so that the bore is longer. However, such a solution aggrevates an already very difficult punching operation as the elongate cavities would then be of insufficient size to receive the type of die which would be required to provide the support necessary to enable the punching operation to be carried out in a satisfactory manner. This solution is almost impossible to apply where the upright is of a complex shape having lipped channels arranged in back-to-back pairs.

Another solution that has been proposed is found in Swiss Pat. No. 363138. In this patent a simple channel has one of its side flanges punched to provide, on the inner face thereof, a dimple which protrudes into the cavity. The head of the bracket is formed so as to catch on the dimple. One problem with the simple form of the invention of Swiss Pat. No. 363138 is that it is necessary, as a dimple is formed, to form a corresponding depression in the outer face of the punched flange. Such depressions are unsightly and the upright is not very acceptable for use in domestic shelving, retail shelving and any other place where it is visible to the public.

In the Swiss patent there is also disclosed a way in which an upright having a number of lipped channels facing in opposite directions can be punched to provide dimples in each channel. The procedure required is complex and, as with the simpler form, the depressions which are inherently formed when the webs are punched to form dimples are again unsightly and visible through the entrances to the channels. Also, access to the inside of each channel to enable the dimples to be punched is difficult in view of the fact that the cavities are small and it is difficult to get a punch in one cavity and a support in the adjacent cavity to prevent undesirable bending of the extrusion when punching pressure is applied.

The object of the present invention is to provide a system including means for positively locating the bracket thereby to prevent it slipping down the upright while at the same time avoiding costly punching operations and the formation of unsightly dimples or other deformations visible from externally of the upright.

According to the present invention there is provided the combination of a structural element and a bracket, the structural element comprising a core structure, two webs extending outwardly from the core structure, and a lip on the outer end of each web, the lips being directed towards one another and defining between them a main slot-like entrance to an elongate main cavity bounded by the lips, the webs and the core structure, and the bracket including a head which can be received in said main cavity and a protruding boss, said element including a further elongate cavity, the further elongate cavity being in the core structure and there being a further slot-like entrance placing the further cavity in communication with the main cavity, the core structure including at least one transverse surface for engagement with said boss, which boss enters said further cavity through said further slot-like entrance when said head is received in the main cavity, to prevent movement of the bracket along the structural element once the boss is engaged with said surface.

In one form the core structure includes two further lips, the further lips defining between them said further slot-like entrance, said further slot-like entrance being widened at at least one place to provide said transverse surface. In this form it is possible for segments to be removed and for the boss to be circular in cross section.

In another structural form the core structure includes two further lips, the further lips defining between them said further slot-like entrance, and there being an elongate element located in said further cavity, the elongate element extending across said further slot-like entrance and having therein a series of apertures for receiving said boss.

For a better understanding of the present invention, and to show how the same may be carried into effect, reference will now be made, by way of example, to the accompanying drawings in which.

Figure 1:
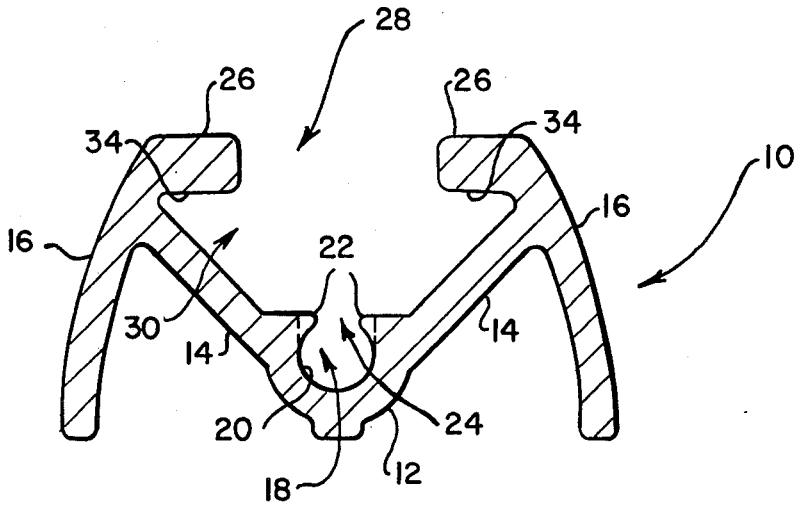
FIG. 1 is a section through an aluminium extrusion.

Referring firstly to FIG. 1, an aluminium extrusion 10 is illustrated which comprises a central core structure 12, two webs 14 which extend outwardly from the core structure 12, and two peripheral formations 16.

The central core structure 12 is formed with a longitudinally extending cavity 18 the bounding wall 20 of which extends through somewhat more than 270° thereby to provide two lips 22 which bound a slot-like entrance 24.

The formations 16 each include a lip 26, the lips 26 protruding towards one another and defining a slot-like entrance 28 leading into an elongate cavity 30 bounded by the lips 26, the webs 14 and the core structure 12. It will be seen from FIG. 1 that the entrance 28 places the cavity 18 in communication with the cavity 30.

At intervals along the length of the extrusion 10 the lips 22 are shaped so as to provide zones at which the entrance 24 is wider than elsewhere. One such zone is designated 32 in FIG. 2 and it will be seen that two segments of the lips 22 have been removed forming two, opposed segment-shaped openings. Removal of these segments can be by punching, drilling, cutting or any other convenient machine or hand operation.

The rear faces 34 of the lips 26 can, if desired, be provided with a plurality of parallel serrations (not shown) extending in the direction of elongation of the extrusion. These, as will be described in more detail hereinafter, assist in providing an interlock between a bracket and the extrusion 10.

Figure 5:
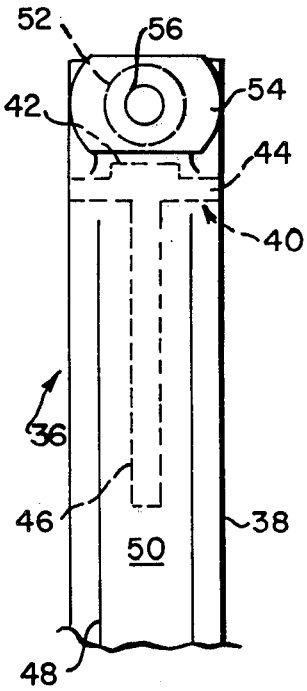
FIG. 5 is a partial rear elevation of the bracket of FIGS. 3 and 4.
Figure 3:
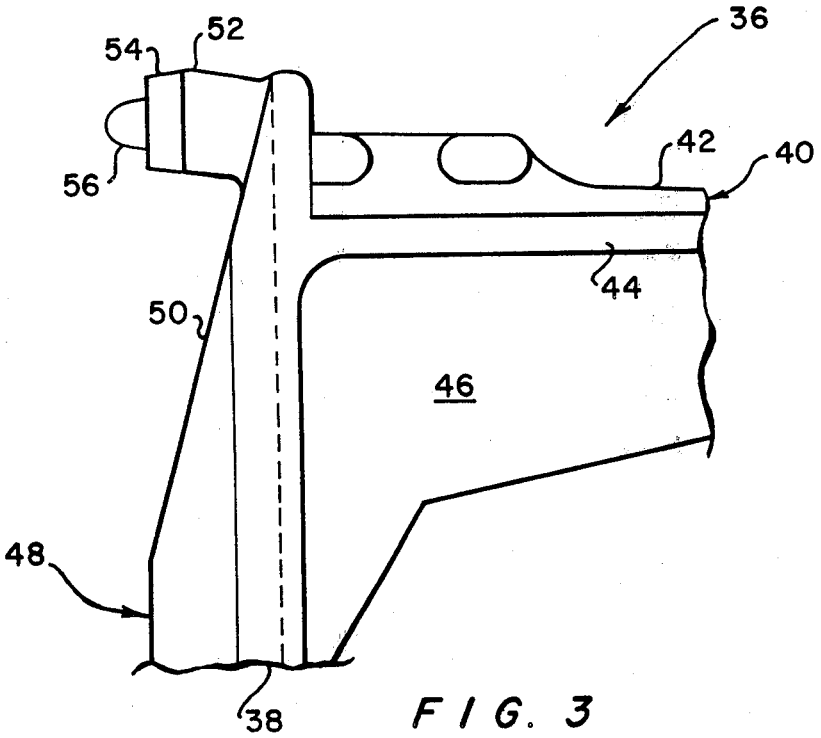
FIG. 3 is a partial side elevation of a bracket.
Figure 4:
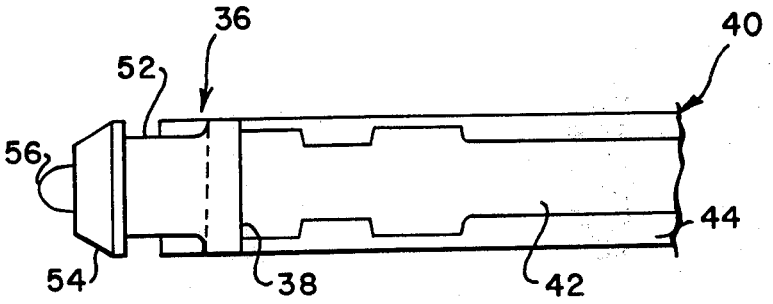
FIG. 4 is a partial top plan view of the bracket of FIG. 3.

Turning now to FIGS. 3 to 5, the bracket illustrated is designated 36 and comprises a main plate 38 which is wider than the entrance 28 and which, in height, is preferably at least twice the width of the entrance 28. Extending forwardly from the plate 38 is a flange 40 which is generally of inverted T-shape. The "'upright" of the T is designated 42 and the cross bar of the T is designated 44. Extending downwardly from the underside of the cross bar 44 is a triangular strengthening web 46 (see particularly FIG. 3).

The bracket 36 further includes a rearward extension 48, the rearwardly facing surface 50 part of the extension 48 being inclined with respect to vertical. This is best seen in FIG. 3.

A round neck 52 protrudes from the plate 38. From FIG. 3 it will be seen that the neck 52 does not protrude horizontally from the plate 38 but slopes slightly upwardly. The diameter of the neck 52 is less than the width of the entrance 28.

A head 54 is provided at the free end of the neck 52. Measured vertically, see FIG. 5, the head is not substantially greater in extent than the diameter of the neck 52 and is such that, when appropriately presented to the entrance 28, it can pass through the entrance 28. In the horizontal direction, again as viewed in FIG. 5, the head 54 is substantially larger than the neck 52 and the length of the head measured in the horizontal direction is greater than the width of the entrance 28. A boss 56 protrudes from the rear face of the head 54.

The bracket 36 can be cast in aluminium or another suitable metal.

The bracket 36 is mounted on the extrusion 10 by presenting the bracket to the extrusion with the web 46 horizontal. This means that the head 54 is orientated so that its maximum dimension is vertical and the head 54 and neck 52 can thus pass through the entrance 28 between the lips 26 into the cavity 30. The dimensions of cavity 30 are such that once the head 54 is within the cavity 30, the bracket 36 can be rotated through 90° so that the web 46 is vertical. The angled configuration of the surface part 50 ensures that the main part of the bracket 36 does not interfere with rotation of the bracket 36 after it has been presented to the extrusion in the manner described.

The boss 56 enters the cavity 18 at one of the zones 32. Engagement between the boss 56 and the curved edges which bound the zone 32 prevents the bracket 36 from moving downwardly with respect to the extrusion 10. When the bracket 36 is loaded, for example, by means of a shelf placed on the flange 40, those surfaces of the head 54 which face the plate 38 bear on the inner faces 34 of the lips 26. Furthermore the lower part of the plate 38 bears against the outer surfaces of the lips 26. Frictional engagement between the bracket 36 and the extrusion 10, which engagement is enhanced if the faces 34 are serrated as described above, inhibits movement of the bracket 36 downwardly with respect to the extrusion. The boss 56, by virtue of its co-operation with the zone 32, positively locates the bracket and prevents the bracket slipping downwardly regardless of how heavily it is loaded.

If it is desired to move the bracket to another level, it is merely necessary to rotate it through 90° so that the head 54 is orientated with its maximum dimension vertical The head 54 can then pass through the entrance 28 and be reinserted at the level of another zone 32.

The bracket 36 illustrated is specifcally intended to support a shelf. It will be understood, however, that the nature of the bracket will depend on its function. Thus shapes other than that illustrated are required if the brackets are to serve as coat and hat hangers, to serve as light fitting supports, or to support rails on which clothing and other articles can be hung.

Figure 7:
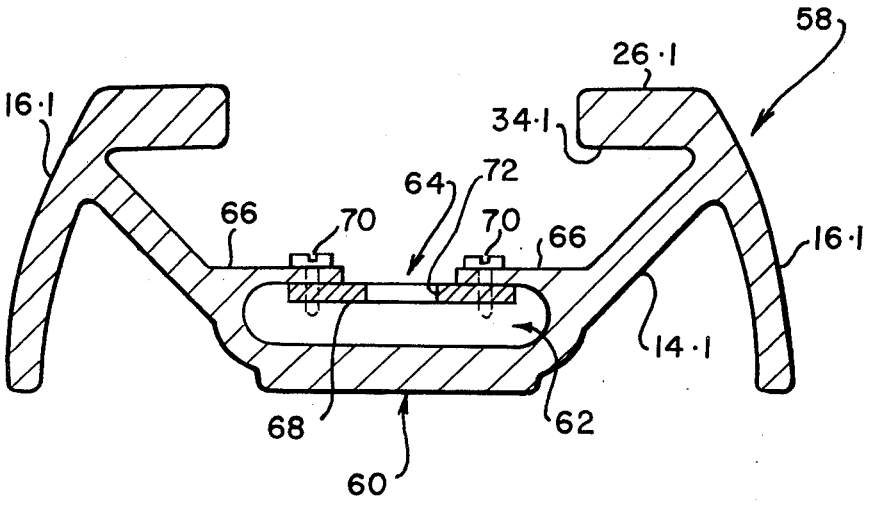
FIG. 7 is a horizontal section on the line VII—VII of FIG. 6.
Figure 6:
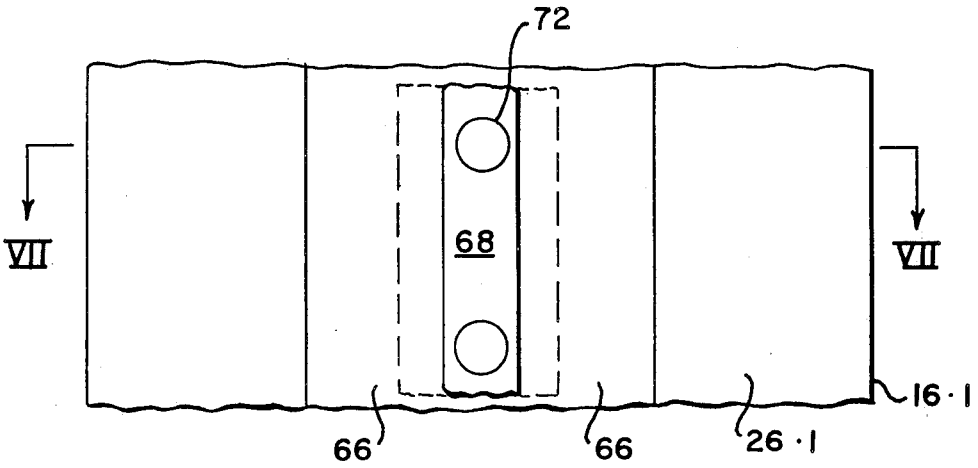
FIG. 6 is a front elevation of another form of extrusion.

Turning now to FIG. 6 and 7, an extrusion 58 is illustrated which includes a central core structure 60 incorporating an elongate cavity 62. The cavity 62 is equivalent to the cavity 18 of FIG. 1 but, as will be clearly seen from FIG. 6, it is of substantially different shape. The slot-like entrance to the cavity 62 is designated 64 and is bounded by lips 66. The remainder of the extrusion is substantially the same as the extrusion shown in FIG. 1 and, where applicable, like parts have been designated with the same reference numerals with the addition of the suffix 1.

An elongate element 68 extends along the groove 62 and is suitably secured, by mechanical elements such as rivets or screws or in any other way, to the inner faces of the lips 66. Simply by way of example, self tapping screws 70 are shown holding the element 68 in place. At intervals along its length the element 68 is punched to provide a series of holes 72. As will clearly be seen from FIG. 6, the diameter of each hole 72 is less than the width of the entrance 64. It will be understood that each hole 72 can receive the boss 56 of the bracket 36.

To enable brackets 36 to protrude in more than one direction from the extrusion, further webs 14 and further formations 16 can be provided. For example, with reference to FIG. 1, the core 12 can be extended to enable one, two or even three more cavities 18 to be provided therein. If it is desired that there be a total of four cavities 18, then two additional webs 14 are provided and the illustrated long limbs of the formations 16 are replaced by shorter limbs equivalent to the lips 26. With an element of this nature, brackets can extend in four directions from the core and there can moreover be four brackets at the same level without interfering with one another.

Where large brackets are being used, there can be one or more additional bosses below the boss 56 illustrated and which enter the cavity 18 through lower zones 32.

Figure 2:
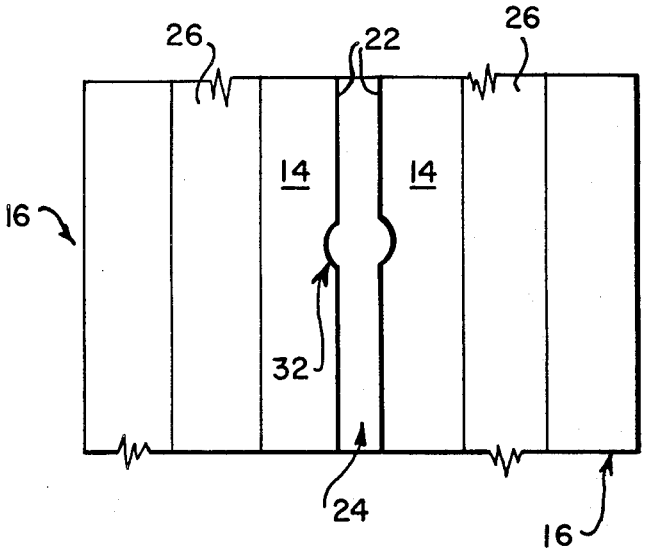
FIG. 2 is a front elevation of a length of the extrusion of FIG. 1.

If desired a single zone 32 can be provided in the arrangement of FIGS. 1 and 2. In this form the bracket in addition to the boss 56 also has a further boss below the boss 56. After the boss 56 has been inserted in the cavity 18 by way of the zone 32, the lower boss is worked into the cavity 18 by deforming the lips 22. The degree of deformation which can be obtained is such that the bracket can then be removed and lowered, the boss 56 being inserted in the newly widened portion of the entrance 24. This procedure can be repeated to obtain as many bracket mounting positions as desired.

The element 68 can, if desired, be replaced by an element which substantially fills the cavity 18 and which has apertures or recesses for the boss 56.

What is claimed is:

1. A support system, comprising a one-piece, unitary, elongated structural element having a core structure, two webs extending outwardly from said core structure, a first pair of lips on outer ends of said webs directed toward but spaced from one another, and defining a first slot therebetween, a first elongated cavity defined by and between said first lips, said webs and said core structure, a second elongated cavity in said core structure defined by a second pair of opposed and spaced lips extending into said first cavity adjacent junctures of said core structure and said webs, and at least one widening in said second pair of lips forming a transverse surface; and a bracket having a head receivable in said first cavity, a protruding boss extending from said head and receivable in said widening in engagement with said transverse surface, and a neck receivable in said first slot and connecting said head to support structure extending exteriorly of said structural element;

whereby said boss engages said transverse surface preventing movement of said bracket along said element once said boss is inserted in said widening.

2. A support system according to claim 1 wherein said widening is formed by opposed segment-shaped openings formed in said second lips, said opening having cords substantially co-linear with free edges of said second lips.

3. A support system according to claim 2 wherein said boss is circular in transverse cross-section.

4. A support system according to claim 2 wherein said head comprises lateral extensions for engaging interior surfaces of said first lips when said head is located in said first cavity.

5. A support system according to claim 2 wherein said second lips are relatively thin.

6. A support system according to claim 2 wherein said widening and said boss have mating transverse shapes.

* * * * *